US006935574B2

(12) United States Patent
Cheng

(10) Patent No.: US 6,935,574 B2
(45) Date of Patent: Aug. 30, 2005

(54) TOY-VEHICLE TRACK SECTION

(75) Inventor: Chor Kit Cheng, New Territories (HK)

(73) Assignee: Turbo Tec Company Limited, Kowloon (HK)

( * ) Notice: Subject to any disclaimer, the term of this patent is extended or adjusted under 35 U.S.C. 154(b) by 0 days.

(21) Appl. No.: 10/704,589

(22) Filed: Nov. 12, 2003

(65) Prior Publication Data

US 2005/0098645 A1 May 12, 2005

(51) Int. Cl.[7] ..... E01B 23/00
(52) U.S. Cl. ..... 238/10 B; 238/10 E; 238/10 F
(58) Field of Search ..... 238/10 R, 10 A, 238/10 B, 10 C, 10 E, 10 F

(56) References Cited

U.S. PATENT DOCUMENTS

| | | | | |
|---|---|---|---|---|
| 1,800,956 A | | 4/1931 | Peterson, Jr. | |
| 3,025,626 A | | 3/1962 | Schumacher | |
| 3,414,194 A | | 12/1968 | Seitzinger et al. | |
| 3,579,904 A | | 5/1971 | Genin | |
| 3,690,031 A | | 9/1972 | Shinoda | |
| 3,750,945 A | | 8/1973 | Warr | |
| 4,346,889 A | | 8/1982 | Barlow et al. | |
| 4,504,243 A | | 3/1985 | Barlow et al. | |
| 4,544,094 A | | 10/1985 | Scholey | |
| 4,941,611 A | | 7/1990 | Arsenault | |
| 4,953,786 A | | 9/1990 | Arsenault | |
| 5,160,091 A | | 11/1992 | Hesse | |
| 5,454,513 A | * | 10/1995 | Wilson | 238/10 E |
| 5,579,997 A | | 12/1996 | Jackson et al. | |
| 6,382,519 B1 | | 5/2002 | Choi | |
| 6,398,121 B1 | | 6/2002 | Morgan | |
| 6,427,926 B1 | | 8/2002 | Lai | |
| 6,648,237 B2 | * | 11/2003 | Rothkopf et al. | 238/10 E |

* cited by examiner

*Primary Examiner*—Mark T. Le
(74) *Attorney, Agent, or Firm*—Armstrong, Kratz, Quintos, Hanson & Brooks, LLP

(57) ABSTRACT

A two sided reversible toy-vehicle track section for guiding a toy-vehicle. A plurality of substantially identical track sections having a single groove pattern on both sides are connectable in various ways to form straight tracks, right-hand directed tracks, and left-hand directed tracks. The track sections are preferably fabricated of wood.

18 Claims, 7 Drawing Sheets

TOY-VEHICLE TRACK SECTION

FIELD OF THE INVENTION

The invention relates to track sections for use in forming track patterns for a toy-vehicle.

BACKGROUND OF THE INVENTION

Tracks for toy-vehicles such as trains, cars, and the like formed by assembling a plurality of track sections are known. The track sections are commonly fabricated of wood, metal or plastic, and are commonly linked together to form a track pattern by interlocking a projection on one track section with a recess on another track section. Track sections are known having interlocking means to link a plurality of track sections together in an end to end fashion to form a track pattern, as disclosed in U.S. Pat. No. 4,544,094 to Scholey. Also known are track sections having interlocking means on multiple sides of a square or oblong track section to form track patterns of a more complex arrangement, as disclosed in U.S. Pat. No. 3,414,194 to Seitzinger et al. Often track sections have one track pattern section on one face and a different track pattern section on the other face, and the track pattern sections vary from track section to track section in order that a large number of track patterns can be assembled by varying the different track sections, as disclosed in U.S. Pat. No. 4,941,611 to Arsenault.

Referring to FIGS. 10A and 10B, in one prior-art track section having one projection 1 and one recess 2 for end to end assembly, it is known to have a straight section 3 and a curve section 4, the curve section having a first face 5 and a second face 6 (hidden) so that a direction of curvature can be selected by having the appropriate face facing upward in a track pattern. In such a set, a track pattern of a circle, or parallel straight sections having semi-circular ends, for example, can be assembled with use of the two basic track section shapes. Such a set typically includes a "crossover" piece in order that a "figure 8" type track pattern can also be assembled.

In the end to end type track sections as described above, in particular those fabricated of wood, a significant amount of wood is wasted when the curved section is fabricated, as rectangularly shaped pieces of wood are typically used and a board width wider than the actual width of the track section is required to obtain the curve section. Also, two configurations of basic track sections (not considering a cross-over piece) are needed to assemble the track patterns described above.

It is an object of the present invention to provide a single configuration for a basic track section which can be combined with like basic track sections to assemble a straight track, a left-hand directed track, and a right-hand directed track, for use in forming track patterns.

It is another object of the present invention to fabricate such a single configuration basic track section in a manner which does not waste the material used for fabrication.

SUMMARY OF THE INVENTION

A two sided reversible track section is provided for forming a track for guiding a toy-vehicle. The track section is a body having a first face, a second face and a peripheral edge extending between the faces. A single track pattern is formed on both the first and second faces, and a male connector and a complimentary female connector are formed on the peripheral edge. Each track section is configured such that a plurality of the same, when connected in selected arrangements, form a straight track, a right-hand directed track, and a left-hand directed track. The directions of the tracks are in reference to a direction of travel from the male connector toward the female connector of each track section.

BRIEF DESCRIPTION OF THE DRAWINGS

The invention will become more readily apparent from the following description of preferred embodiments, shown, by way of example only, in the accompanying drawings, wherein.

DETAILED DESCRIPTION OF THE INVENTION

Figure 1:
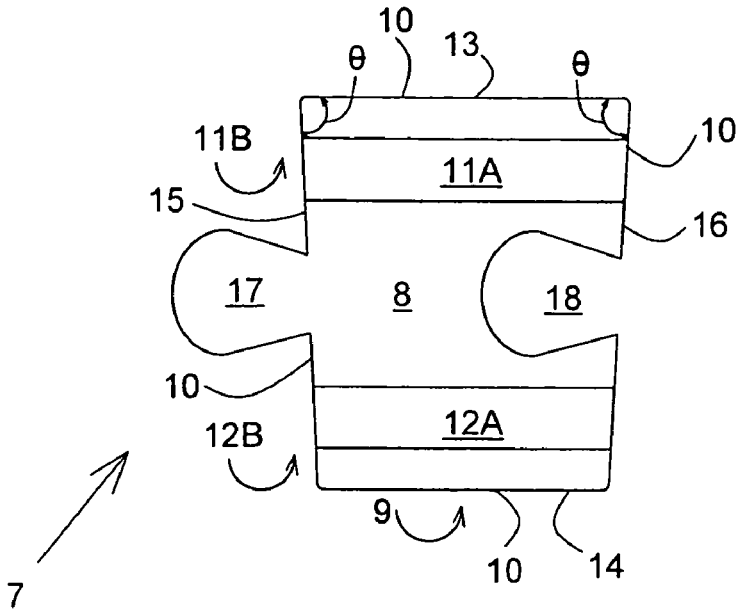
FIG. 1 is a top view of a track section of the invention having tongue type connectors.

Referring to FIG. 1, the two sided reversible toy-vehicle track section 7 of the invention is a body having a first face 8, a second face 9 (hidden) and a peripheral edge 10 extending between the faces. The term reversible refers to the fact that both faces have guide grooves to form a track pattern, and either face can be directed upward when assembling a track pattern. The preferred material of the body is wood, however any material, including plastic and metal is available for practice of the invention.

In first face 8 of the track section 7, grooves 11A and 12A are provided. The grooves are selected to have a spacing and a groove width corresponding to the wheel spacing and wheel width of the toy-vehicle to be used on the track, when assembled. The grooves 11A and 12A are arranged to be parallel to side portions 13 and 14 of the peripheral edge 10 of the track section. The grooves 11A and 12A in the first face 8 are substantially identical to grooves 11B and 12B (hidden in FIG. 1: See FIG. 6A) in second face 9 of track section 7. The track section has end portions 15 and 16 of the peripheral edge 10, which together with the side portions 13 and 14 of the peripheral edge, define an equilateral trapezoid. That is, side portions 13 and 14 are parallel to each other, and end portions 15 and 16 are non-parallel to each other and are directed at an angle θ from side portion 13. Formed on end portion 15 is a male connector 17, and formed on the opposed other end portion 16 is a complimentary female connector aperture 18. In the embodiment of FIG. 1 a "tongue" shaped connector is provided.

Figure 2:
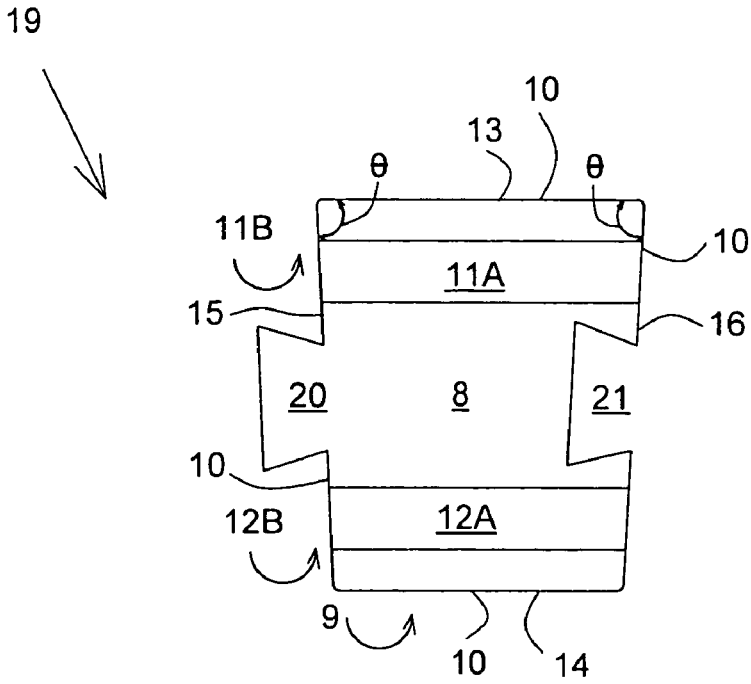
FIG. 2 is a top view of a track section of the invention having dovetail type connectors.

FIG. 2 shows a track section 19 of the invention having features identical to the track section of FIG. 1, with the exception of the connectors. In FIG. 2, the male connector 20 has a "dovetail" shape and the complimentary female connector aperture 21 is of a complementary shape. Although a tongue shaped and a dovetail shaped connectors are shown, connectors of any shape which would connect the sections together are available in practice of the invention.

Figure 3:
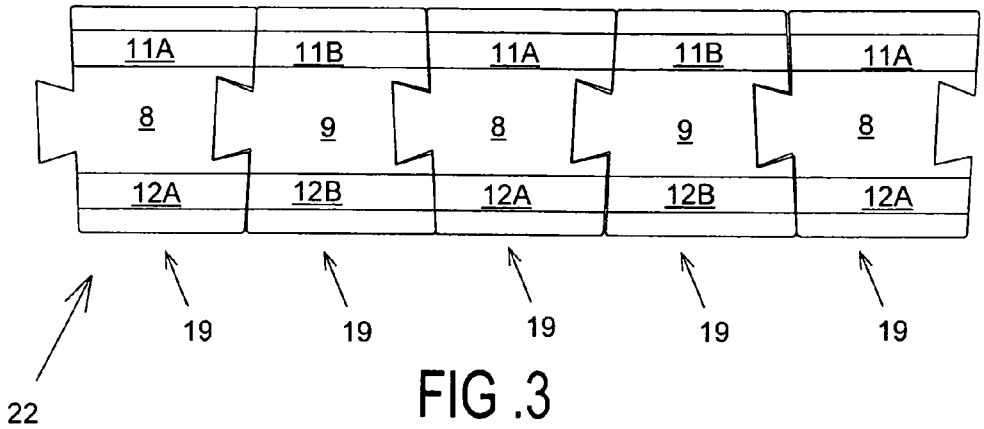
FIG. 3 is a top view of a plurality of the track sections of the invention arranged to form a straight track.
Figure 4:
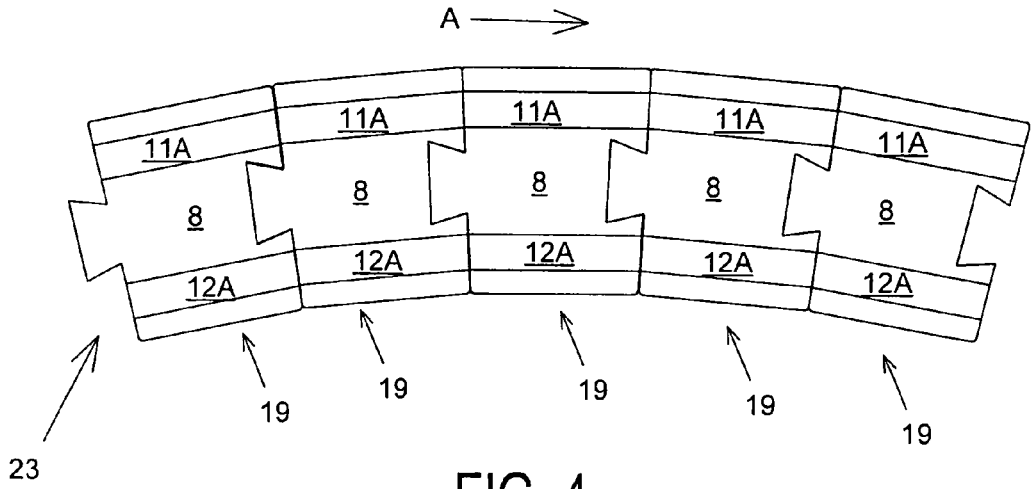
FIG. 4 is a top view of a plurality of the track sections of the invention arranged to form a right-hand directed track.
Figure 5:
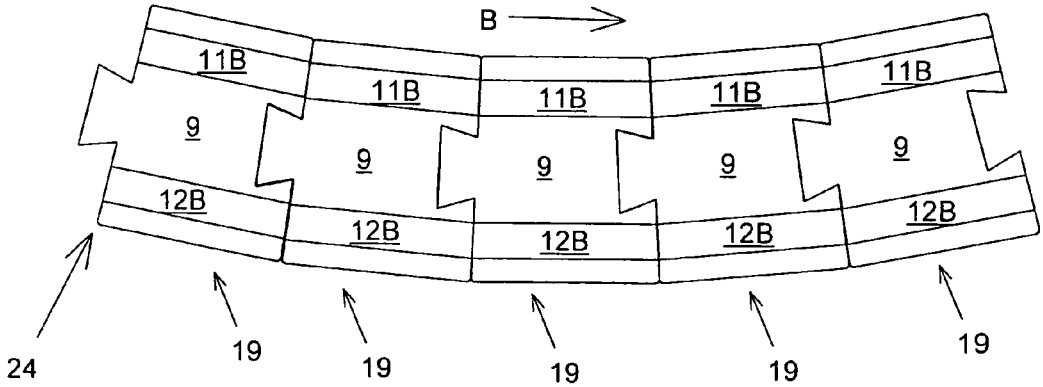
FIG. 5 is a top view of a plurality of the track sections of the invention arranged to form a left-hand directed track.

A track section of the invention is configured so that when a plurality of the track sections (for example track section 19 of FIG. 2) are connected end-to-end, with end portions 15 and 16 in contact with each other, straight tracks, right-hand directed tracks, and left-hand directed tracks can be formed. FIGS. 3, 4, and 5 respectively, depict such tracks. In FIGS. 3, 4, and 5 track sections having the dovetail type connector are depicted, however the track section embodiment 7 of FIG. 1 can be assembled in the same manner. When the track sections are connected end-to-end, grooves of adjacent track sections communicate with each other.

FIG. 3 depicts a straight track 22 formed by a plurality of track sections 19 connected end-to-end with faces 8 and 9 alternating in placement along the length of the track. Such placement provides a straight track. Groove 11A communicates with an adjacent groove 11B, etc; and groove 12A communicates with an adjacent groove 12B, etc.

FIG. 4 depicts a right-hand directed track 23 formed by a plurality of track sections 19 connected end-to-end with only faces 8 in an upward direction along the length of the track. Such placement provides a right-hand directed track. Groove 11A communicates with an adjacent groove 11A, etc; and groove 12A communicates with an adjacent groove 12A, etc.

FIG. 5 depicts a left-hand directed track 24 formed by a plurality of track sections 19 connected end-to-end with only faces 9 in an upward direction along the length of the track. Such placement provides a left-hand directed track. Groove 11B communicates with an adjacent groove 11B, etc.; and groove 12B communicates with an adjacent groove 12B, etc. The directions of the tracks, referred to above, correspond to a resulting direction of travel of the toy-vehicle when moving from the male connector toward the female connector of each of the track sections forming the track. For example, in FIG. 4 such direction of movement, indicated by directional arrow A, results in a right-hand directed track; in FIG. 5 such direction of movement, indicated by directional arrow B, results in a left-hand directed track.

Figure 6A:
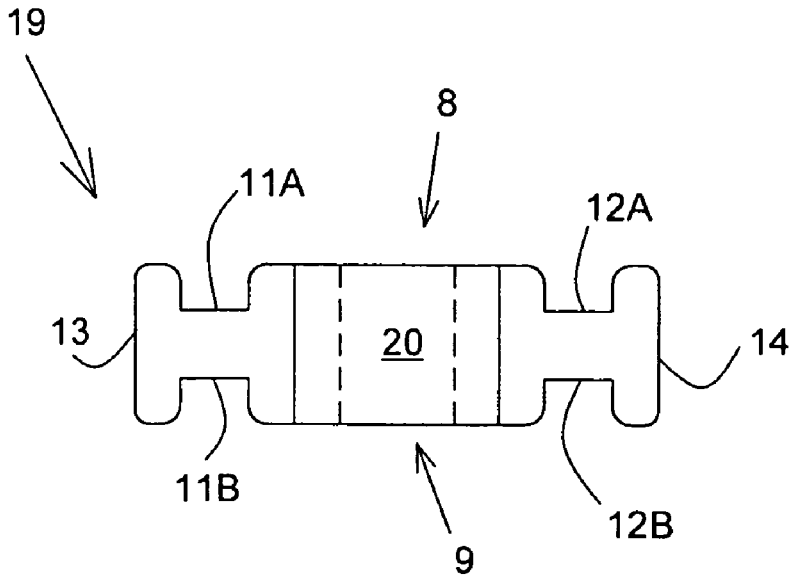
FIG. 6A is an end view of the track section of the invention from the end having a male dovetail connector.
Figure 6B:
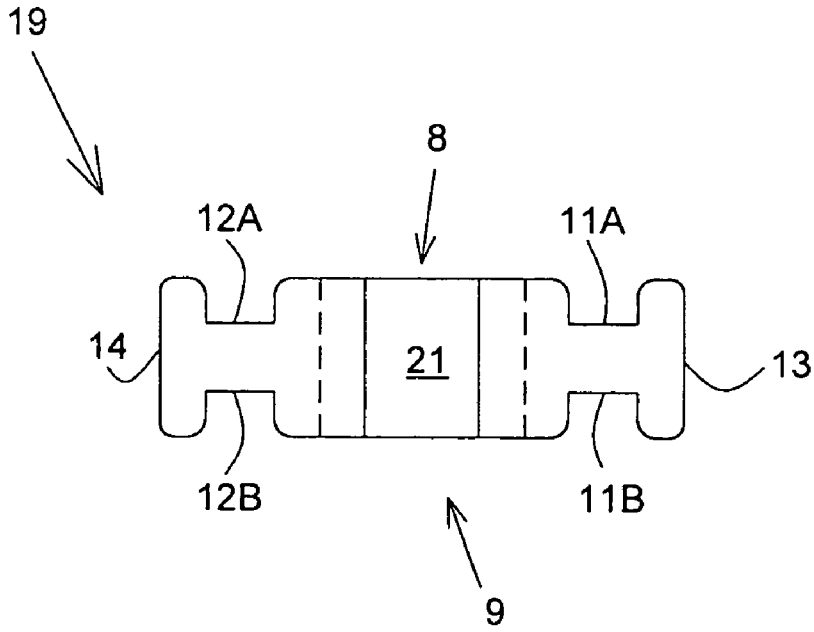
FIG. 6B is an end view of the track section of the invention from the end having a female dovetail connector.

FIGS. 6A and 6B are end views of track section 19 of the invention, as shown previously in FIG. 2. FIG. 6A is a view from the end having male connector 20. FIG. 6B is a view from the end having female connector 21. In FIGS. 6A and 6B, the grooves 11A and 12A of face 8 are shown, as well as the substantially identically configured grooves 11B and 12B of face 9.

Figure 7A:
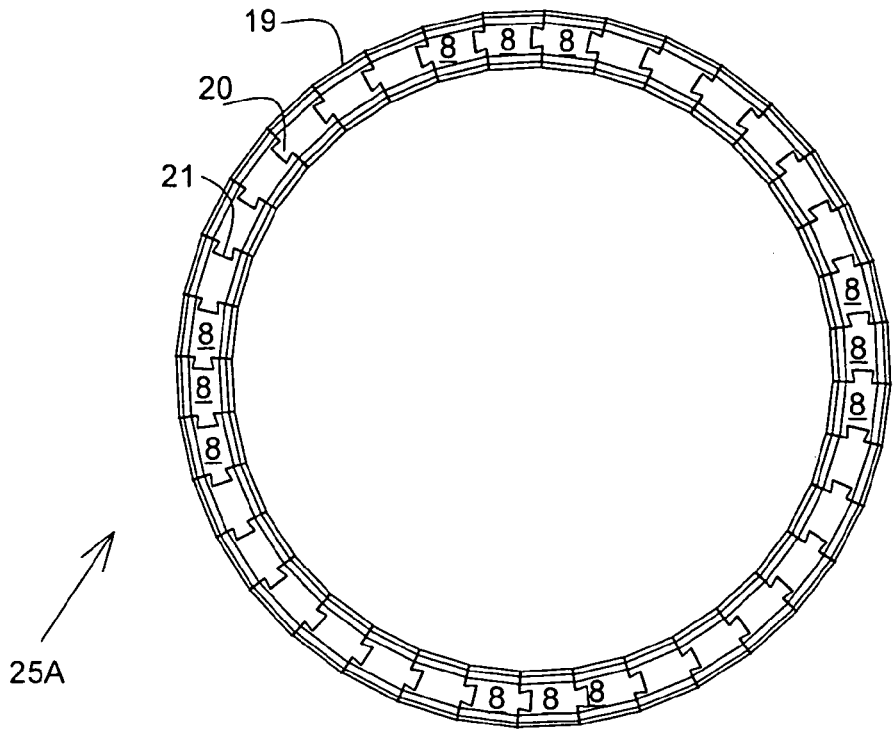
FIGS. 7A and 7B are generally circular track patterns formed from a plurality of track sections of the invention.
Figure 7B:
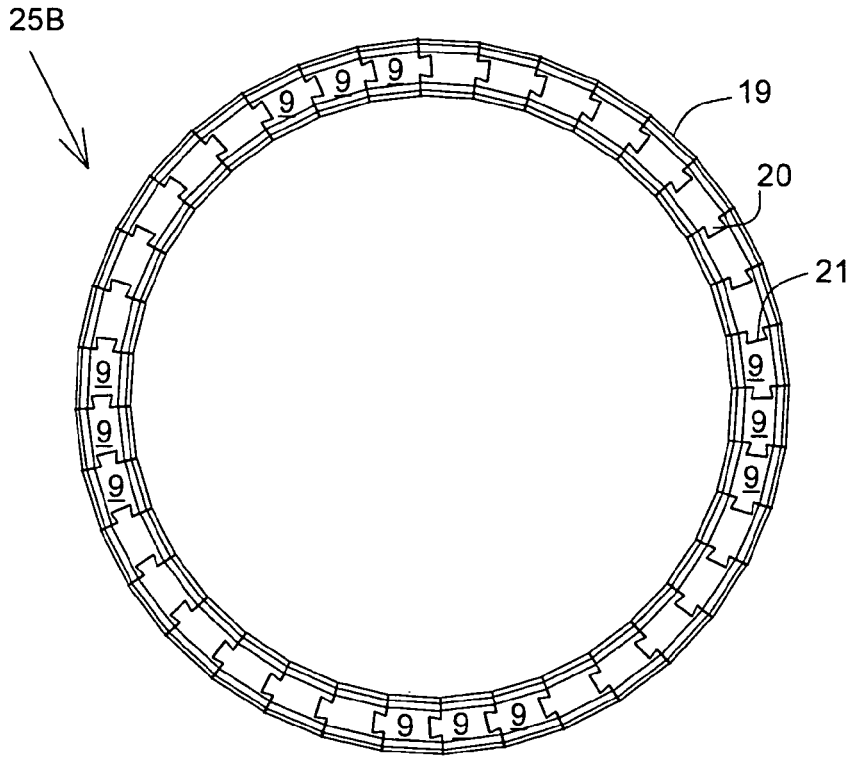

FIGS. 7A and 7B, 8A and 8B, and 9 show various track patterns possible with use of the present invention. FIG. 7A is a generally circular track pattern 25A wherein all of the track sections 19 have face 8 facing upward to form a generally circular track for guiding the toy-vehicle. FIG. 7B is also a generally circular track pattern 25B wherein all of the track sections 19 have face 9 facing upward.

Figure 8A:
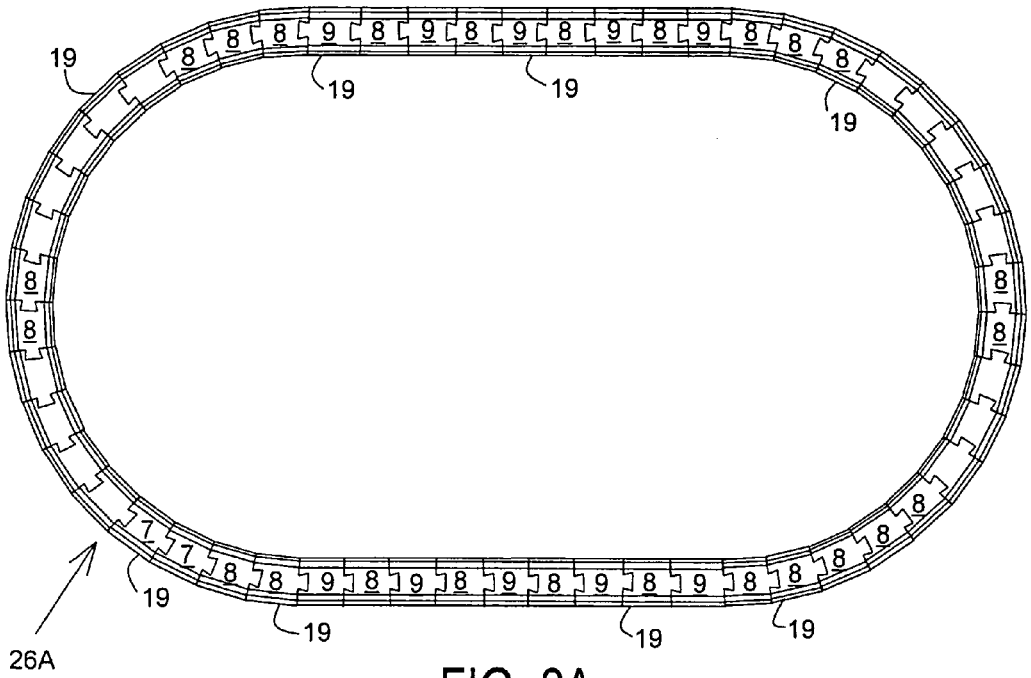
FIGS. 8A and 8B are track patterns, formed from a plurality of track sections of the invention, having two parallel straight portions and generally semi-circular end portions.
Figure 8B:
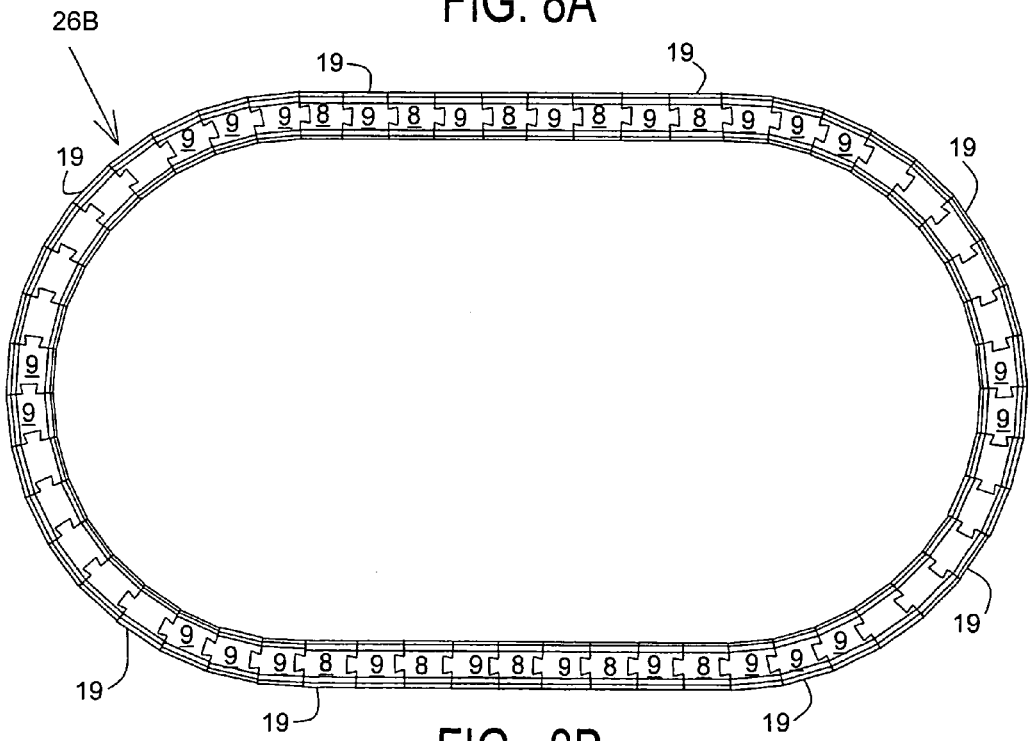

FIG. 8A is a track pattern 26A having two parallel straight portions with generally semi-circular ends, which can be formed by inserting two straight track patterns into the generally circular pattern of FIG. 7A. In the straight portions, the track sections 19 have alternating faces (8, 9) in the upward facing direction, along the length of the track. The generally semi-circular ends have only faces 8 facing upward. FIG. 8B is a track 26B which also has two parallel straight portions with generally semicircular ends. In the straight portions, the track sections 19 have alternating faces (8, 9) in the upward facing direction, along the length of the track. The generally semi-circular ends have only faces 9 facing upward.

Figure 9:
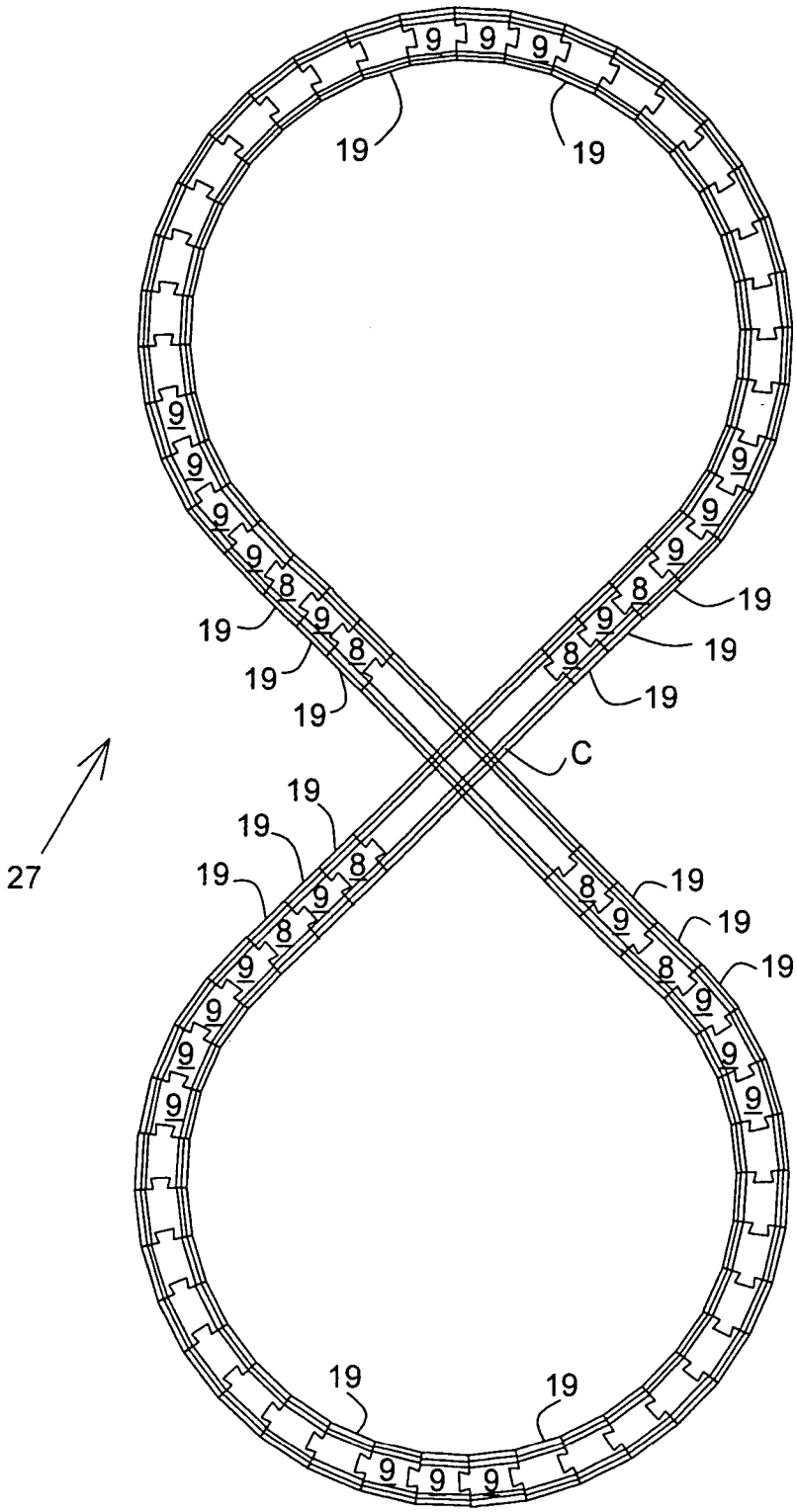
FIG. 9 is a "figure-8" track pattern, formed from a plurality of track sections of the invention and a "cross-over" track section.
Figure 10A:
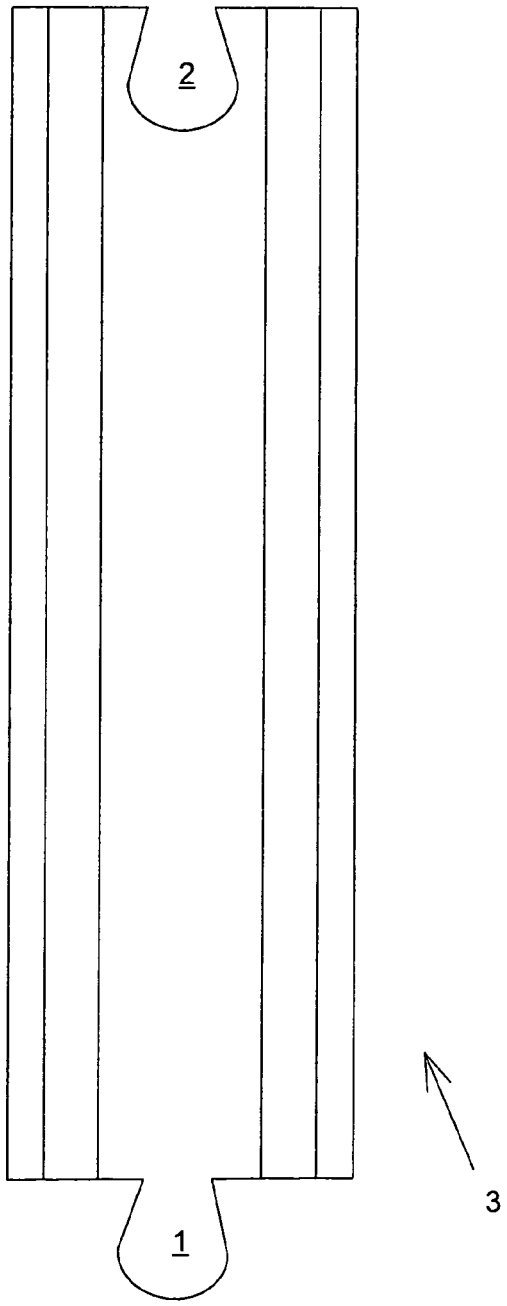
FIG. 10A PRIOR ART
FIGS. 10A and 10B are a straight and curve section respectively, of prior-art track sections.
Figure 10B:
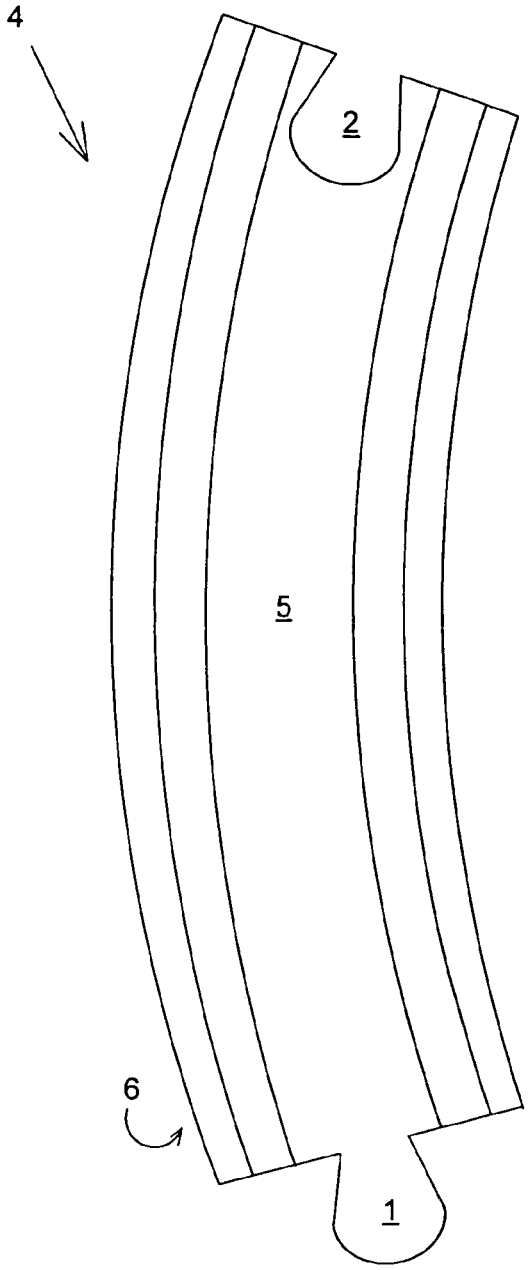
FIG. 10B PRIOR ART

FIG. 9 is a "figure 8" track pattern 27 which requires a "cross-over" track section C, having grooves communicating with the grooves of the track sections, in addition to the plurality of track sections of the invention. The straight and generally circular portions are assembled as described above.

The track is described as being "generally circular" because the track sections, when joined together with all of the track sections having the same face in an upward direction, does not form a true circle. Due to the size of the track sections and the size of the angles θ of the trapezoid shape, the track patterns appear to have a circular shape.

In the preferred embodiment the angle θ, shown in FIG. 1, is between about 83–87 degrees. The distance between groove centerlines and the width of the grooves is determined by the toy-vehicle to be used with the assembled track.

The present invention has the advantages of being able to form both the straight portions and the left and right directed portions of a track from a plurality of the same track sections. Also, because of the smaller size of each track section, in relation to track sections of the prior art, when wood is used as the material of construction, the amount of wood used to form track sections of a selected length is less than that used for forming a similar length track sections of the prior-art, and there is no curved portions in each track section.

While specific materials, shapes, etc. have been set forth for purposes of describing embodiments of the invention, various modifications can be resorted to, in light of the above teachings, without departing from Applicant's novel contributions; therefore in determining the scope of the present invention, reference shall be made to the appended claims:

What is claimed is:

1. A reversible track section for guiding a toy-vehicle, comprising a body having a first face, a second face and a peripheral edge extending between said faces, a single track pattern formed on both the first face and the second face, and a male connector and a complimentary female connector formed on said peripheral edge, wherein said reversible track section is configured such that when a set of track sections consisting a plurality of reversible track sections, each of which is the same as said reversible track section, is connected in selected arrangements, the set of track sections by themselves defines a straight track, a right-hand directed track, and a left-hand directed track, the directions of said tracks being in reference to a direction of travel on the track from the male connector toward the female connector of the each track section.

2. The track section of claim 1, wherein the single track pattern is two linear grooves formed parallel to each other.

3. The track section of claim 2, wherein the peripheral edge includes two side portions and two end portions, said side portions being parallel to said two linear grooves.

4. The track section of claim 3, wherein said male connector is formed in one end portion of the peripheral edge, and said female connector is formed in the other end portion of the peripheral edge.

5. The track section of claim 1, wherein said male connector is of a tongue shape or a dovetail shape.

6. The track section of claim 1, wherein a plurality of said track sections when connected end-to-end so as to alternate in an upward facing first face to an upward facing second face sequence, form a straight track;

when connected end-to-end so as to have all first faces facing upward, form a right-hand directed track; and when connected end-to-end so as to have all second faces facing upward, form a left-hand directed track.

7. The track section of claim 1, wherein said body is fabricated from wood.

8. A reversible track section for guiding a toy-vehicle, comprising a body having a first face, a second face and a peripheral edge extending between said faces, a single track pattern formed on both the first face and the second face, and a male connector and a complimentary female connector formed on said peripheral edge, wherein said track section is configured such that a plurality of the same, when connected in selected arrangements, form a straight track, a right-hand directed track, and a left-hand directed track, the directions of said tracks being in reference to a direction of travel on the track from the male connector toward the female connector of the each track section;

the single track pattern is two linear grooves formed parallel to each other;

the peripheral edge includes two side portions and two end portions, said side portions being parallel to said two linear grooves;

said male connector is formed in one end portion of the peripheral edge, and said female connector is formed in an opposed other end portion of the peripheral edge; and said side portions and said end portions of the peripheral edge define an equilateral trapezoid.

9. A reversible track section for guiding a toy-vehicle, comprising a body having a first face, a second face and a peripheral edge extending between said faces, said peripheral edge defining an equilateral trapezoid, a single track pattern formed of two parallel linear grooves on both the first face and the second face, and a male connector and a complimentary female connector formed on non-parallel edges of said peripheral edge, wherein said track section is configured such that a plurality of the same, when connected in selected arrangements, form a straight track, a right-hand directed track, and a left-hand directed track, the directions of said tracks being in reference to a direction of travel on the track from the male connector toward the female connector of the each track section.

10. A method of fabricating a reversible track section for guiding a toy-vehicle, comprising providing a body having a first face, a second face and a peripheral edge extending between said faces, forming a single track pattern on both the first face and the second face, and forming a male connector and a complimentary female connector on said peripheral edge, configuring said reversible track section such that when a set of track sections consisting a plurality of reversible track sections, each of which is the same as said reversible track section, is connected in selected arrangements, the set of track sections by themselves defines a straight track, a right-hand directed track, and a left-hand directed track, the directions of said tracks being in reference to a direction of travel on the track from the male connector toward the female connector of the each track section.

11. The method of fabricating the track section of claim 10, wherein the single track pattern is formed as two linear grooves formed parallel to each other.

12. The method of fabricating the track section of claim 11, wherein the peripheral edge is formed to include two side portions and two end portions, said side portions being parallel to said two linear grooves.

13. The method of fabricating the track section of claim 12, wherein said male connector is formed in one end portion of the peripheral edge, and said female connector is formed in the other end portion of the peripheral edge.

14. The method of fabricating the track section of claim 10, wherein said male connector is formed as a tongue shape or a dovetail shape.

15. The method of fabricating the track section of claim 10, wherein a plurality of said track sections when connected end-to-end so as to alternate in an upward facing first face to an upward facing second face sequence, form a straight track;

when connected end-to-end so as to have all first faces facing upward, form a right-hand directed track; and when connected end-to-end so as to have all second faces facing upward, form a left-hand directed track.

16. The method of fabricating the track section of claim 10, wherein said body is fabricated from wood.

17. A method of fabricating a reversible track section for guiding a toy-vehicle, comprising providing a body having a first face, a second face and a peripheral edge extending between said faces;

forming a single track pattern on both the first face and the second face; and forming a male connector and a complimentary female connector on said peripheral edge; wherein said track section is configured such that a plurality of the same, when connected in selected arrangements, form a straight track, a right-hand directed track, and a left-hand directed track, the directions of said tracks being in reference to a direction of travel on the track from the male connector toward the female connector of the each track section;

the single track pattern is formed as two linear grooves formed parallel to each other;

the peripheral edge is formed to include two side portions and two end portions, said side portions being parallel to said two linear grooves;

said male connector is formed in one end portion of the peripheral edge, and said female connector is formed in an opposed other end portion of the peripheral edge; and said side portions and said end portions of the peripheral edge define an equilateral trapezoid.

18. A method of fabricating a reversible track section for guiding a toy-vehicle, comprising providing a body having a first face, a second face and a peripheral edge extending between said faces, said peripheral edge defining an equilateral trapezoid, forming a single track pattern of two parallel linear grooves on both the first face and the second face, and forming a male connector and a complimentary female connector on non-parallel edges of said peripheral edge, wherein said track section is configured such that a plurality of the same, when connected in selected arrangements, form a straight track, a right-hand directed track, and a left-hand directed track, the directions of said tracks being in reference to a direction of travel on the track from the male connector toward the female connector of the each track section.

* * * * *